US007679352B2

(12) United States Patent
Peng et al.

(10) Patent No.: US 7,679,352 B2
(45) Date of Patent: Mar. 16, 2010

(54) BANDGAP REFERENCE CIRCUITS

(75) Inventors: Yan-Hua Peng, Miaoli County (TW); Uei-Shan Uang, Taichung County (TW)

(73) Assignee: Faraday Technology Corp., Hsin-Chu (TW)

( * ) Notice: Subject to any disclaimer, the term of this patent is extended or adjusted under 35 U.S.C. 154(b) by 373 days.

(21) Appl. No.: 11/755,722

(22) Filed: May 30, 2007

(65) Prior Publication Data

US 2008/0297130 A1 Dec. 4, 2008

(51) Int. Cl.
*G05F 3/20* (2006.01)

(52) U.S. Cl. ..... 323/313

(58) Field of Classification Search ..... 323/311–317
See application file for complete search history.

(56) References Cited

U.S. PATENT DOCUMENTS 4,302,718 A * 11/1981 Schade, Jr. ..... 323/313
5,315,230 A * 5/1994 Cordoba et al. ..... 323/313
6,340,882 B1 * 1/2002 Chung et al. ..... 323/315
6,841,982 B2 * 1/2005 Tran ..... 323/316
7,112,947 B2 * 9/2006 Draxelmayr ..... 323/315
7,166,994 B2 * 1/2007 Lee et al. ..... 323/313
7,307,468 B1 * 12/2007 Vasudevan ..... 327/539
7,514,987 B2 * 4/2009 Lin ..... 327/539
2004/0233600 A1 * 11/2004 Yoshida et al. ..... 361/90
2008/0297130 A1 * 12/2008 Peng et al. ..... 323/313

* cited by examiner

*Primary Examiner*—Adolf Berhane
*Assistant Examiner*—Yemane Mehari
(74) *Attorney, Agent, or Firm*—Winston Hsu

(57) ABSTRACT

A bandgap reference circuit comprises: a current generator for generating an output current, the current generator comprising a first reference unit and a plurality of second reference units arranged in parallel, where the current generator is capable of determining the magnitude of the output current according to the reference units; a first resistor, coupled between a first terminal of the first reference unit and a node, for transmitting a first current; a second resistor, coupled to the node and a first terminal of each second reference unit, for transmitting a second current; a third resistor, coupled between the node and an output terminal of the bandgap reference circuit, for transmitting a third current; and a current-to-voltage converter, coupled to the third resistor, for generating a bandgap voltage according to the output current and the third current.

20 Claims, 10 Drawing Sheets

| Prior art | | Embodiment | |
|---|---|---|---|
| R1' | 8.67K Ω | R1" | 8.67K Ω |
| R2' | 1153.11K Ω | RA | 25K Ω |
| | | R2" | 564.06K Ω |
| R3' | 150K Ω | R3" | 150K Ω |
| R1'+2R2'+R3' | 2464.89K Ω | R1"+2RA+R2"+R3" | 772.73K Ω |

Fig. 10

BANDGAP REFERENCE CIRCUITS

BACKGROUND OF THE INVENTION

1. Field of the Invention

The present invention relates to generating of bandgap voltages, and more particularly, to bandgap reference circuits.

2. Description of the Prior Art

Please refer to FIG. 1. FIG. 1 is a diagram of a bandgap reference circuit 100 according to the prior art. As shown in FIG. 1, the current I1 within the bandgap reference circuit 100 is a current proportional to absolute temperature, where the current is generally referred to as a PTAT current. The current I1 is related to bipolar junction transistors (BJTs) Q1-0, Q1-1, Q1-2, . . . , and Q1-N and is further related to a resistor R1, and can be represented by utilizing the following equation:

$$I1=V_T*In(N)/R1.$$

In the above equation, the thermal voltage $V_T$ can be expressed as follows:

$$V_T=(k*T)/q;$$

where k represents Boltzmann's constant, T represents absolute temperature, and q represents an electric charge equivalent.

In addition, the current I2 within the bandgap reference circuit 100 can be referred to as a complementary to absolute temperature current (i.e. a CTAT current, whose magnitude decreases while absolute temperature increases). The current I2 is related to the BJT Q1-0 and a resistor R2, and can be represented by utilizing the following equation:

$$I2=V_{EB0}/R2;$$

where $V_{EB0}$ represents the emitter-base junction voltage of the BJT Q1-0.

The bandgap voltage VREF outputted from the output terminal of the bandgap reference circuit 100 is generated according to a total current (I1+I2), and can be represented by utilizing the following equation:

$$VREF=(I1+I2)*R3=(R3/R2)*(V_{EB0}+(R2/R1)*In(N)*V_T).$$

Please refer to the FIG. 2. FIG. 2 is a diagram of a bandgap reference circuit 200 according to the prior art, where the p-type metal oxide semiconductor (PMOS) transistors M1', M2', and M3' can be respectively implemented by utilizing the PMOS transistors M1, M2, and M3 shown in FIG. 1, the amplifier 210 can be implemented by utilizing the amplifier 110 shown in FIG. 1, and the diodes D2-0, D2-1, D2-2, . . . , and D2-N may be respectively implemented by utilizing the above-mentioned BJTs Q1-0, Q1-1, Q1-2, . . . , and Q1-N. The current I1' within the bandgap reference circuit 200 can be represented by utilizing the following equation:

$$I1'=\Delta V_{EB}'/R1' \quad (1);$$

where $\Delta V_{EB}'$ represents the difference between bias voltages of diodes such as bias voltages $V_{D2-0}$ and $V_{D2-1}$ (or $V_{D2-2}, V_{D2-3}, \ldots, V_{D2-N}$), and a bias voltage of a diode means the voltage difference between two terminals of the diode. Please note that the voltage $V_{EB}'$ may represent the voltage difference between two terminals of a diode (e.g., the diode D2-0) in a broad sense, while in a narrow sense, the voltage $V_{EB}'$ may represent the voltage difference between two terminals of a diode (e.g., the diode D2-0) that is implemented by utilizing the above-mentioned BJT.

In addition, the current I2' within the bandgap reference circuit 200 can be represented by utilizing the following equation:

$$I2'=(V_{EB}'-VREF')/R2' \quad (2);$$

where VREF' represents the bandgap voltage outputted from the output terminal of the bandgap reference circuit 200, and can be represented by utilizing the following equation:

$$VREF'=(I1'+3*I2')*R3' \quad (3).$$

Equations (1) and (2) can be substituted into Equation (3) such that the following equation can be obtained:

$$VREF'=C*((R2'/(3*R1'))*\Delta V_{EB}'+V_{EB}') \quad (4);$$

where C=(3*R3')/(R2'+3*R3'). Substitute the equation $\Delta V_{EB}'=V_T*\ln(N)$ into Equation (4), another equation can be obtained as follows:

$$VREF'=C*((R2'/(3*R1'))*V_T*In(N)+V_{EB}').$$

According to the prior art, if the newer architecture shown in FIG. 2 is utilized for generating the bandgap voltage, a sufficiently large circuit area is usually required for implementation of the resistor R2'. More particularly in a low voltage condition, each of the diodes D2-1, D2-2, . . . , and D2-N shown in FIG. 2 need a larger circuit area than that of a normal condition, and the number N is therefore limited and can not be arbitrarily increased in accordance with design requirement(s). As the number N can not be arbitrarily increased, in some situations, it is necessary that a larger circuit area should be utilized for implementing the resistor R2', causing the economic benefit to be reduced in a mass production phase. Therefore, a novel solution for improving the prior art is required.

SUMMARY OF THE INVENTION

It is an objective of the claimed invention to provide bandgap reference circuits.

According to one embodiment of the claimed invention, a bandgap reference circuit for generating a bandgap voltage is disclosed. The bandgap reference circuit comprises: a current generator for generating an output current, the current generator comprising a plurality of reference units comprising a first reference unit and a plurality of second reference units arranged in parallel, the current generator being capable of determining the magnitude of the output current according to the plurality of reference units, where a first portion of the output current is a current having a negative temperature coefficient, and a second portion of the output current is a current having a positive temperature coefficient; a first resistor, coupled between a first terminal of the first reference unit and a node, for transmitting a first current; a second resistor, coupled to the node and a first terminal of each second reference unit, for transmitting a second current; a third resistor, coupled between the node and an output terminal of the bandgap reference circuit, for transmitting a third current, where the magnitude of the third current is equal to the sum of the magnitude of the first current and the magnitude of the second current; and a current-to-voltage converter, coupled to the third resistor, for generating the bandgap voltage according to the output current and the third current.

While the bandgap reference circuit mentioned above is provided, a method for generating a bandgap voltage is provided correspondingly. The method comprises: providing a current generator comprising a plurality of reference units for determining the magnitude of an output current, where the plurality of reference units comprises a first reference unit and a plurality of second reference units arranged in parallel; providing a first resistor, a second resistor, and a third resistor; providing a current-to-voltage converter; coupling the first resistor between a first terminal of the first reference unit and a node to transmit a first current; coupling the second resistor to the node and a first terminal of each second reference unit to transmit a second current; coupling the third resistor between the node and an output terminal of the bandgap reference circuit to transmit a third current, where the magnitude of the third current is equal to the sum of the magnitude of the first current and the magnitude of the second current; utilizing the current generator to generate the output current, where a first portion of the output current is a current having a negative temperature coefficient and a second portion of the output current is a current having a positive temperature coefficient; and utilizing the current-to-voltage converter to generate the bandgap voltage according to the output current and the third current.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 10 is a table illustrating the comparison between resistance values of the bandgap reference circuit shown in FIG. 3 and corresponding resistance values of the bandgap reference circuit shown in FIG. 2 according to one embodiment of the present invention.

DETAILED DESCRIPTION

Figure 1:
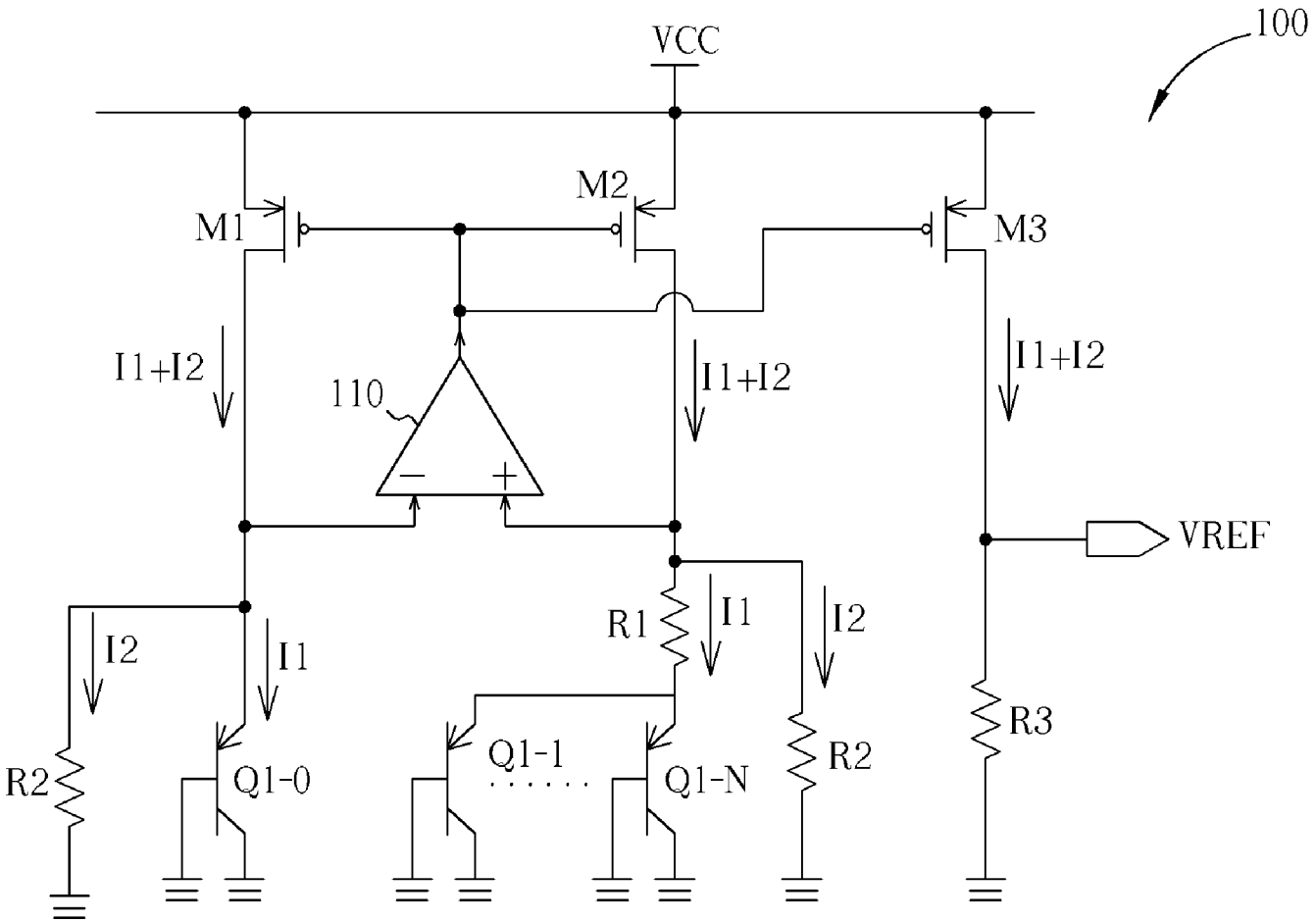
Fig. 1 Prior Art
FIG. 1 is a diagram of a bandgap reference circuit according to the prior art.
Figure 2:
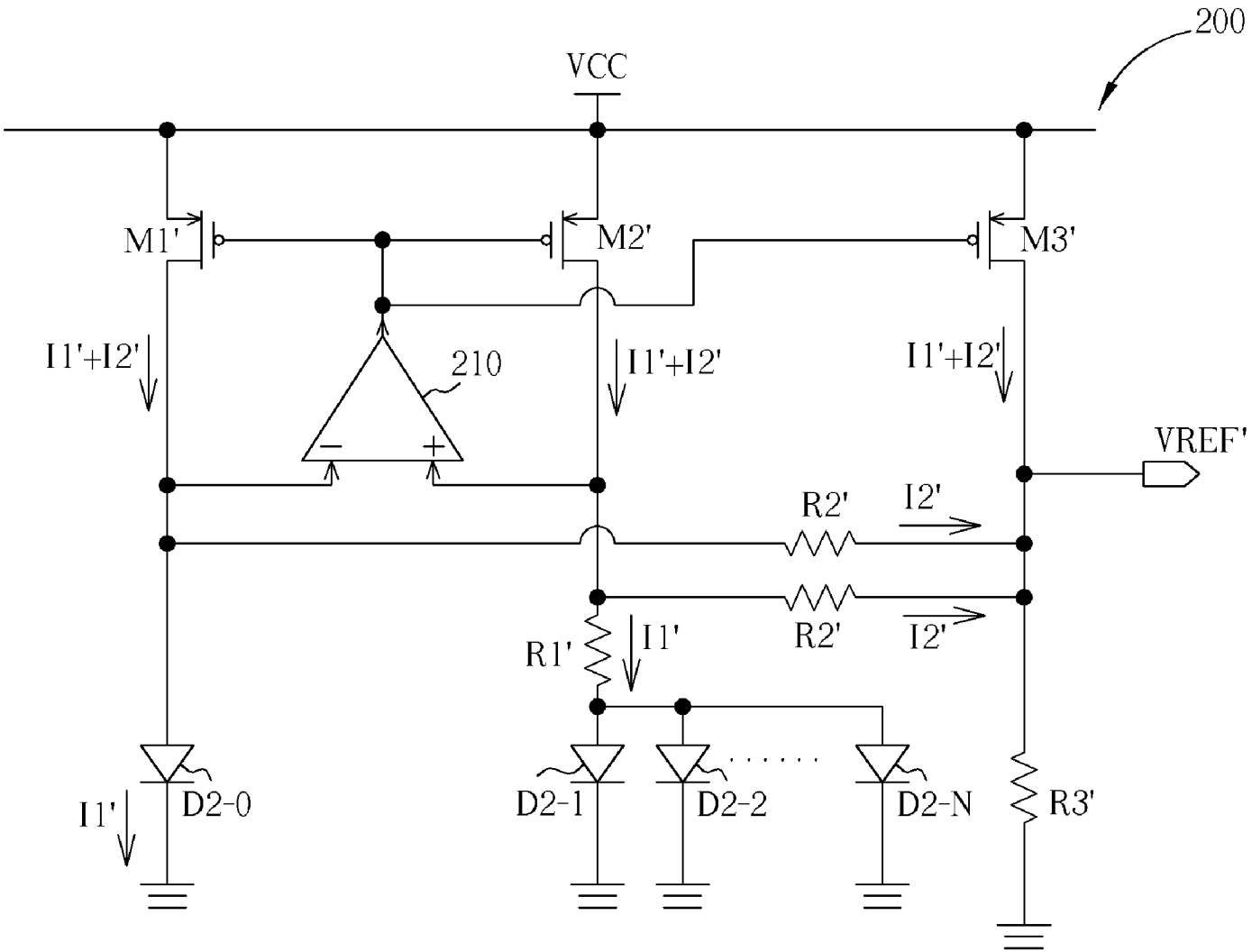
Fig. 2 Prior Art
FIG. 2 is a diagram of another bandgap reference circuit according to the prior art.
Figure 3:
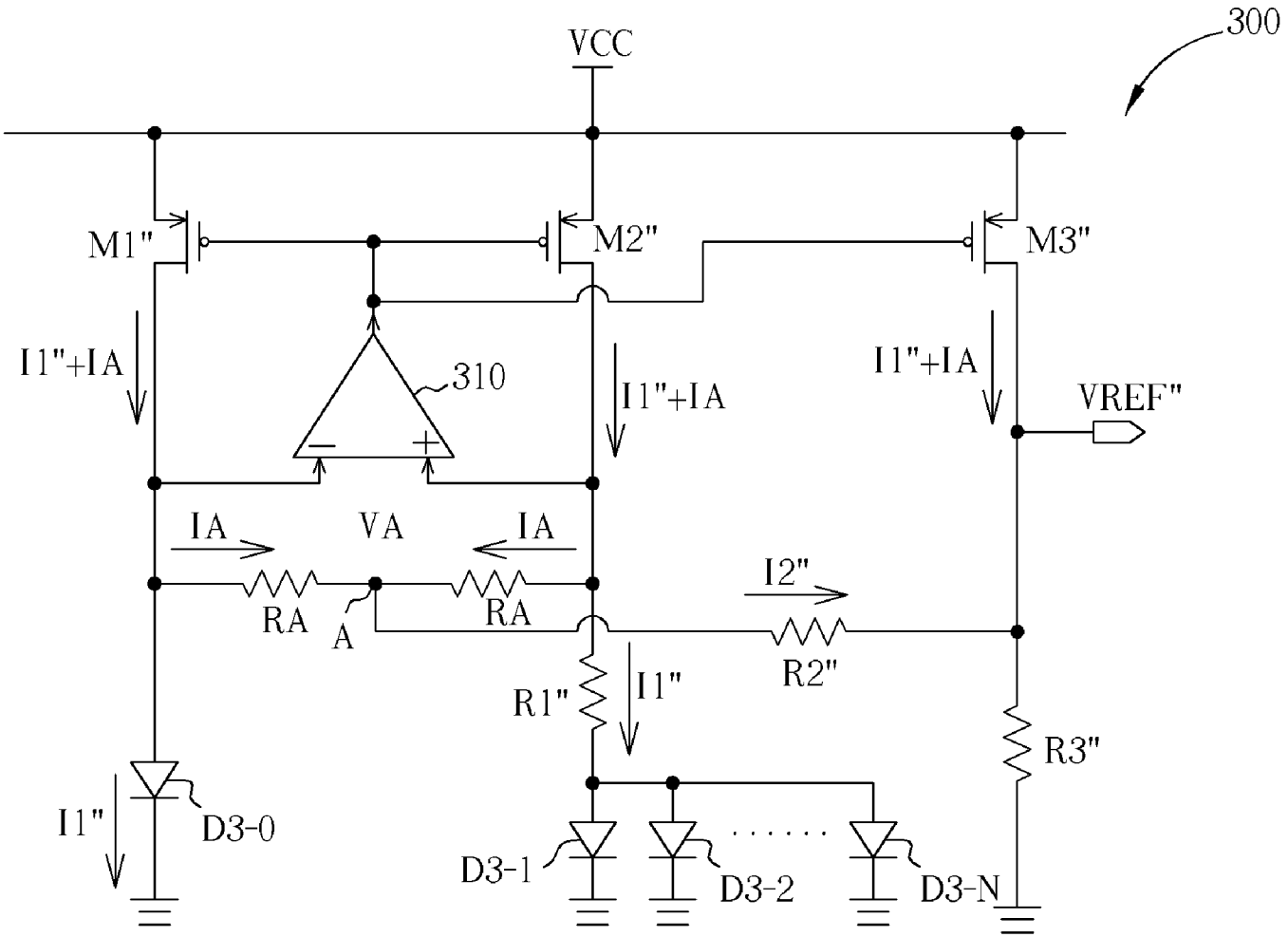
FIG. 3 is a diagram of a bandgap reference circuit according to one embodiment of the present invention.

Please refer to FIG. 3. FIG. 3 is a diagram of a bandgap reference circuit 300 according to one embodiment of the present invention. The bandgap reference circuit 300 comprises a current generator comprising a plurality of reference units, where the plurality of reference units comprises a first reference unit and a plurality of second reference units arranged in parallel. In this embodiment, the first reference unit is a diode D3-0, and the second reference units are diodes D3-1, D3-2, . . . , and D3-N respectively, where the diodes D3-0, D3-1, D3-2, . . . , and D3-N can be respectively implemented by utilizing the diodes D2-0, D2-1, D2-2, . . . , and D2-N shown in FIG. 2 or by utilizing the bipolar junction transistors (BJTs) Q1-0, Q1-1, . . . , Q1-N shown in FIG. 1.

According to the embodiment shown in FIG. 3, the current generator further comprises a resistor R1", an amplifier 301, a plurality of p-type metal oxide semiconductor (PMOS) transistors such as PMOS transistors M1", M2", and M3", where the amplifier 310 can be implemented by utilizing the above-mentioned amplifiers 210 or 110, and the PMOS transistors M1", M2", and M3" can be respectively implemented by utilizing the PMOS transistors M1', M2', and M3' mentioned above or by utilizing the PMOS transistors M1, M2, and M3 mentioned above.

As shown in FIG. 3, the gate of each of the PMOS transistors M1", M2", and M3" is coupled to an output terminal of the amplifier 310, and the source of each of the PMOS transistors M1", M2", and M3" is coupled to an operating voltage VCC. In addition, the drain of the PMOS transistor M1" is coupled to the first reference unit, where the first reference unit of this embodiment is the diode D3-0, the drain of the PMOS transistor M1" is coupled to the positive terminal of the diode D3-0, and the negative terminal of the diode D3-0 is coupled to a reference level such as the ground level shown in FIG. 3. Additionally, the drain of the PMOS transistor M2" is coupled to the upper terminal of the resistor R1", and the lower terminal of the resistor R1" is coupled to each of the second reference units, where the second reference units of this embodiment are the diodes D3-1, D3-2, . . . , and D3-N, the positive terminal of each of the diodes D3-1, D3-2, . . . , and D3-N is coupled to the lower terminal of the resistor R1", and the negative terminal of each of the diodes D3-1, D3-2, . . . , D3-N is coupled to a reference level such as the ground level shown in FIG. 3. According to this embodiment, the amplifier 310 comprises a positive terminal and a negative terminal respectively coupled to the upper terminal of the resistor R1" and the positive terminal of the diode D3-0.

According to the first embodiment, the bandgap reference circuit 300 further comprises three resistors, each of which is coupled to the node A, where the resistor R2" is further coupled to an output terminal of the bandgap reference circuit 300 on the right-hand side of the bandgap reference circuit 300 (i.e., the output terminal where the bandgap voltage VREF" is labeled). In this embodiment, the resistance value of the left-hand side resistor of the node A is substantially equal to that of the right-hand side resistor of the node A, so they are both labeled as RA. As shown in FIG. 3, the bandgap reference circuit 300 further comprises a current-to-voltage converter coupled to the output terminal of the bandgap reference circuit 300 on the right-hand side thereof, where the current-to-voltage converter of this embodiment is the resistor R3", the upper terminal of the resistor R3" is coupled to the resistor R2" and the output terminal of the bandgap reference circuit 300, and the lower terminal of the R3" is coupled to a reference level such as the ground level mentioned above.

As shown in FIG. 3, the left-hand side resistor of the node A is coupled between the node A and the positive terminal of the diode D3-0, for transmitting to the node A the current IA within the output current (I1"+IA) outputted from the drain of the PMOS transistor M1", and the other current I1" within the output current (I1"+IA) from the PMOS transistor M1" is transmitted to the positive terminal of the diode D3-0. Similarly, the right-hand side resistor of the node A is coupled between the node A and the upper terminal of the resistor R1", for transmitting to the node A the current IA within the output current (I1"+IA) outputted from the drain of the PMOS transistor M2", and the other current I1" within the output current (I1"+IA) from the PMOS transistor M2" is transmitted to the positive terminals of the diodes D3-1, D3-2, . . . , and D3-N through the resistor R1". Additionally, the resistor R2" transmits the current I2" from the node A to the upper terminal of the resistor R3", where the magnitude of the current I2" is equal to the sum of the two currents IA respectively transmitted through the two resistors RA, i.e., I2"=2*IA.

The current generator of this embodiment generates an output current (I1"+IA), and outputs the output current (I1"+IA) to the upper terminal of the resistor R3" through the drain of the PMOS transistor M3", where the current generator is capable of determining the magnitude of the output current (I1"+IA) according to the plurality of reference units. The above-mentioned current-to-voltage converter (i.e. the resistor R3" in this embodiment) is capable of generating the bandgap voltage VREF" according to the output current (I1"+IA) and the current I2". According to this embodiment, the current-to-voltage converter converts the total current (I1"+IA+I2") of the output current (I1"+IA) and the current I2" into the bandgap voltage VREF", where I2"=2*IA, so the total current is (I1"+3*IA). Please note that a first portion of the output current (I1"+IA) (i.e., the current I1") is a current having a negative temperature coefficient and a second portion of the output current (I1"+IA) (i.e., the current IA) is a current having a positive temperature coefficient, where the first portion and the second portion of the output current (I1"+IA) of this embodiment are currents of the same direction. In this embodiment, by utilizing the complementary characteristics of the current I1" having the negative temperature coefficient and the current (3*IA) having the positive temperature coefficient within the total current (I1"+3*IA), the total current (I1"+3*IA) generated by the bandgap reference circuit 300 remains substantially unchanged with respect to temperature while the bandgap reference circuit 300 is operating within a predetermined range such as a well-designed operation range, whereby the bandgap voltage VREF" substantially independent of the temperature variation can be obtained. Operation principles of the bandgap reference circuit 300 are described as follows.

The current I1" within the bandgap reference circuit 300 can be expressed by utilizing the following equation:

$$I1''=\Delta V_{EB}''/R1'' \quad (5);$$

where $\Delta V_{EB}''$ in this embodiment represents the difference between bias voltages of diodes such as bias voltages $V_{D3\text{-}0}$ and $V_{D3\text{-}1}$ (or $V_{D3\text{-}2}$, $V_{D3\text{-}3}$, . . . $V_{D3\text{-}N}$), and a bias voltage of a diode means the voltage difference between two terminals of the diode. Please note that the voltage $V_{EB}'$ may represent the voltage difference between two terminals of a diode (e.g., the diode D3-0) in a broad sense, while in a narrow sense, the voltage $V_{EB}'$ may represent the voltage difference between two terminals of a diode (e.g., the diode D3-0) that is implemented by utilizing the above-mentioned BJT. In addition, the current IA within the bandgap reference circuit 300 can be expressed by utilizing the following equation:

$$IA=(V_{EB}''-VA)/RA \quad (6);$$

where VA represents the voltage of the node A. Additionally, the current I2" within the bandgap reference circuit 300 can be expressed by utilizing the following equation:

$$I2''=(VA-VREF'')/R2''=2*IA \quad (7).$$

From Equations (6) and (7), another equation can be obtained as follows:

$$VA=(2*R2''*V_{EB}''+RA*VREF'')/(RA+2*R2'') \quad (8).$$

Substitute Equation (8) into Equation (6), so as to obtain the following equation:

$$IA=(V_{EB}''-VREF'')/(RA+2*R2'') \quad (9).$$

In addition, the bandgap voltage VREF" can be expressed by utilizing the following equation:

$$VREF''=(I1''+3*IA)*R3'' \quad (10).$$

Substitute Equations (5) and (9) into Equation (10) to obtain the following equation:

$$VREF''=C31*(C32*\Delta V_{EB}''+V_{EB}'') \quad (11);$$

where

C31=(3*R3−)/(RA+2*R2"+3*R3"), and

C32=(RA+2*R2")/(3*R1").

In the following, the bandgap reference circuit 300 provided by the first embodiment is compared with the bandgap reference circuit 200 of the prior art according to some operating conditions, where the range of the operating voltage VCC is from 0.9 V to 1.1 V, the range of the operating junction temperature is from −40° C. to 125° C., and the process utilized for manufacturing chip(s) is the 90 nm process known in the art. Thus, the area occupied by the diode D3-0 within the bandgap reference circuit 300 is consistent with that occupied by the diode D2-0 within the bandgap reference circuit 200, i.e., both are 98 micrometer (μm) square. Similarly, the area occupied by the diodes D3-1, D3-2, . . . , and D3-N within the bandgap reference circuit 300 is consistent with that occupied by the diodes D2-1, D2-2, . . . , D2-N within the bandgap reference circuit 200. Then further description can be provided regarding some process variation conditions ("Process Corner" in particular) such as PTNT, PFNF, and PSNS, where three respective simulated curves generated by circuit simulation program(s) are illustrated in each figure from FIG. 4 to FIG. 9, and the three curves from top to bottom respectively correspond to different values of the operating voltage VCC such as 1.1V, 1.2V, and 1.3V.

Figure 4:
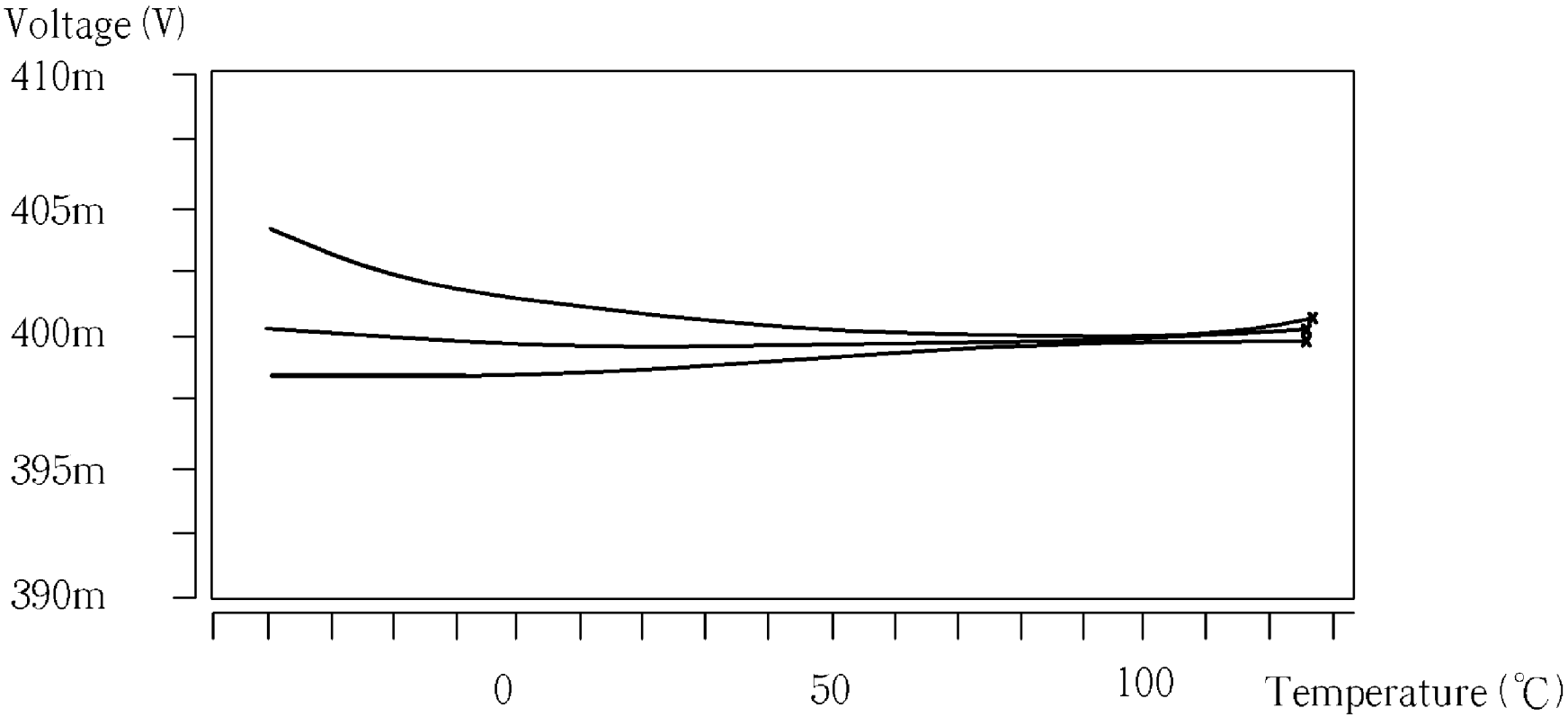
FIG. 4 illustrates the bandgap voltage generated by the bandgap reference circuit shown in FIG. 2 under the condition of PTNT.
Figure 5:
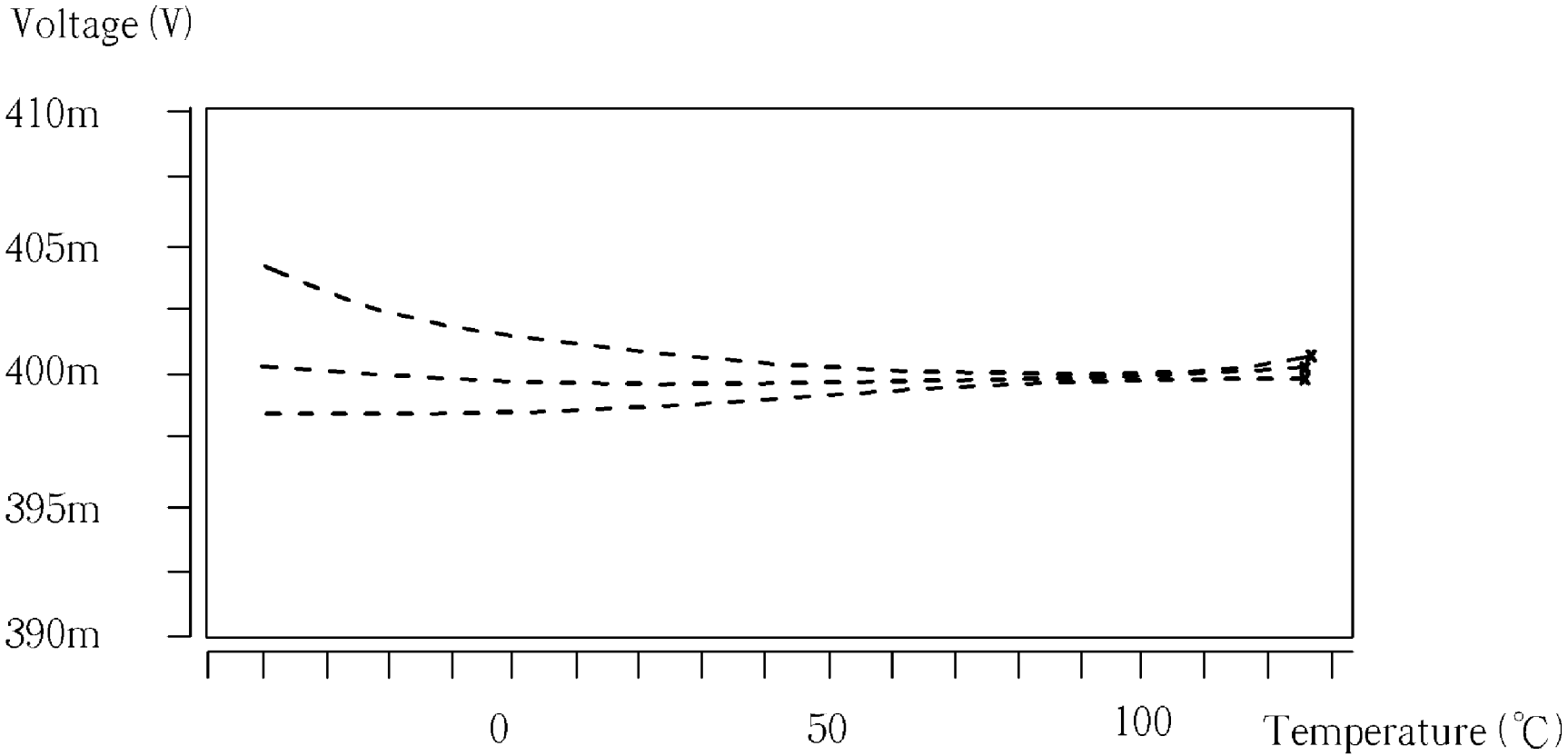
FIG. 5 illustrates the bandgap voltage generated by the bandgap reference circuit shown in FIG. 3 under the condition of PTNT.

Please refer to FIG. 4 and FIG. 5. FIG. 4 is a diagram of the bandgap voltage VREF' generated by the bandgap reference circuit 200 shown in FIG. 2 under the condition of PTNT, and FIG. 5 is a diagram of the bandgap voltage VREF" generated by the bandgap reference circuit 300 shown in FIG. 3 under the condition of PTNT, where the similarity between the two sets of curves means that the bandgap reference circuit 300 have similar performance as the bandgap reference circuit 200.

Figure 6:
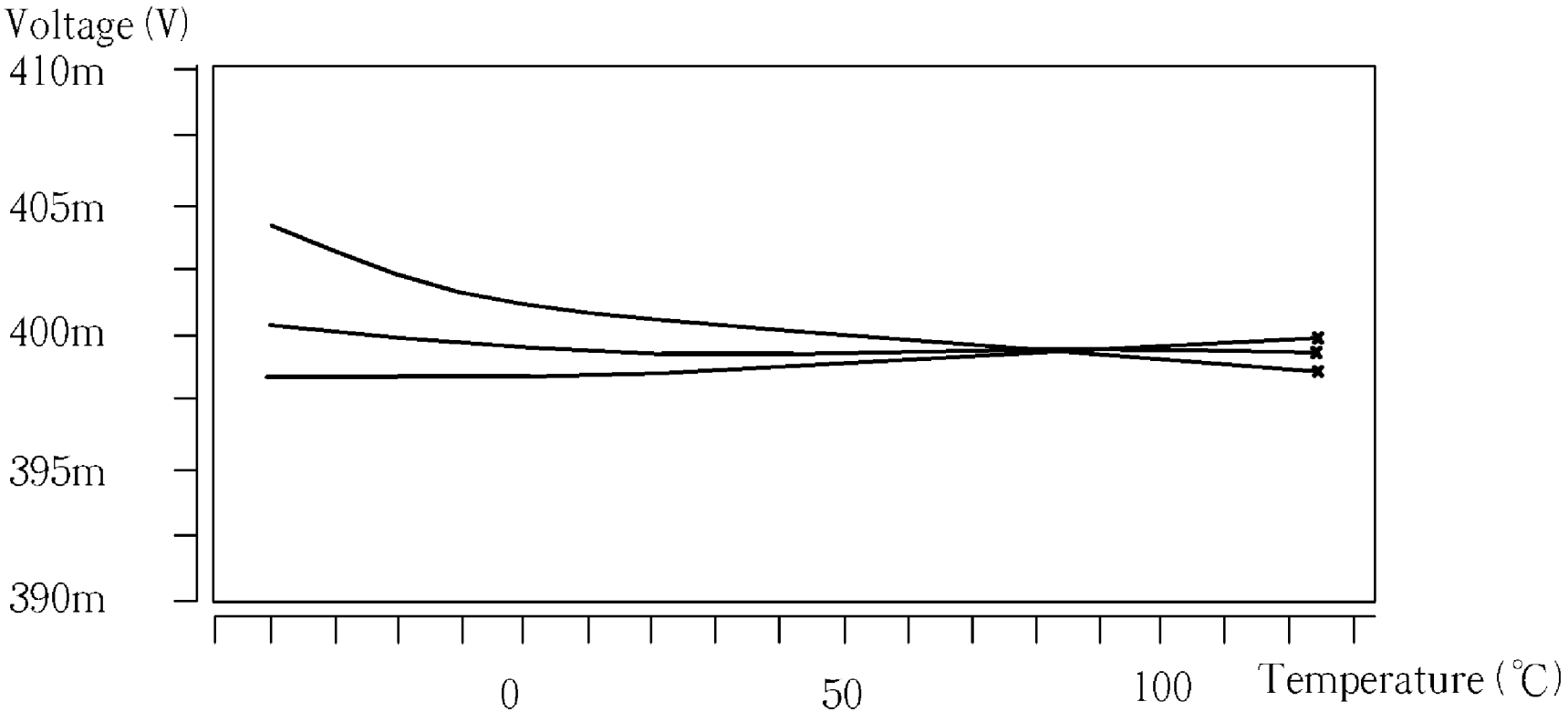
FIG. 6 illustrates the bandgap voltage generated by the bandgap reference circuit shown in FIG. 2 under the condition of PFNF.
Figure 7:
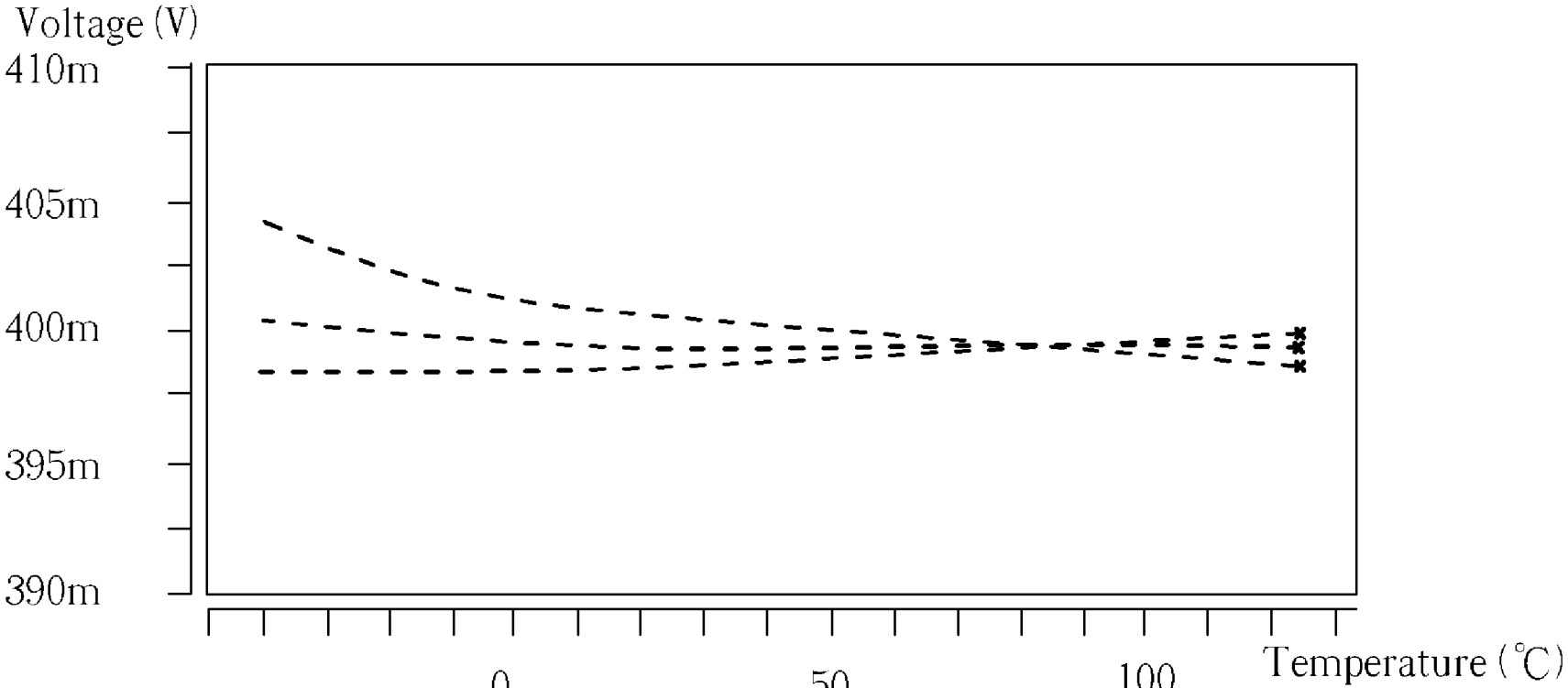
FIG. 7 illustrates the bandgap voltage generated by the bandgap reference circuit shown in FIG. 3 under the condition of PFNF.

Please refer to FIG. 6 and FIG. 7. FIG. 6 is a diagram of the bandgap voltage VREF' generated by the bandgap reference circuit 200 shown in FIG. 2 under the condition of PFNF, and FIG. 7 is a diagram of the bandgap voltage VREF" generated by the bandgap reference circuit 300 shown in FIG. 3 under the condition of PFNF, where the similarity between the two sets of curves means that the bandgap reference circuit 300 have similar performance as the bandgap reference circuit 200.

Figure 8:
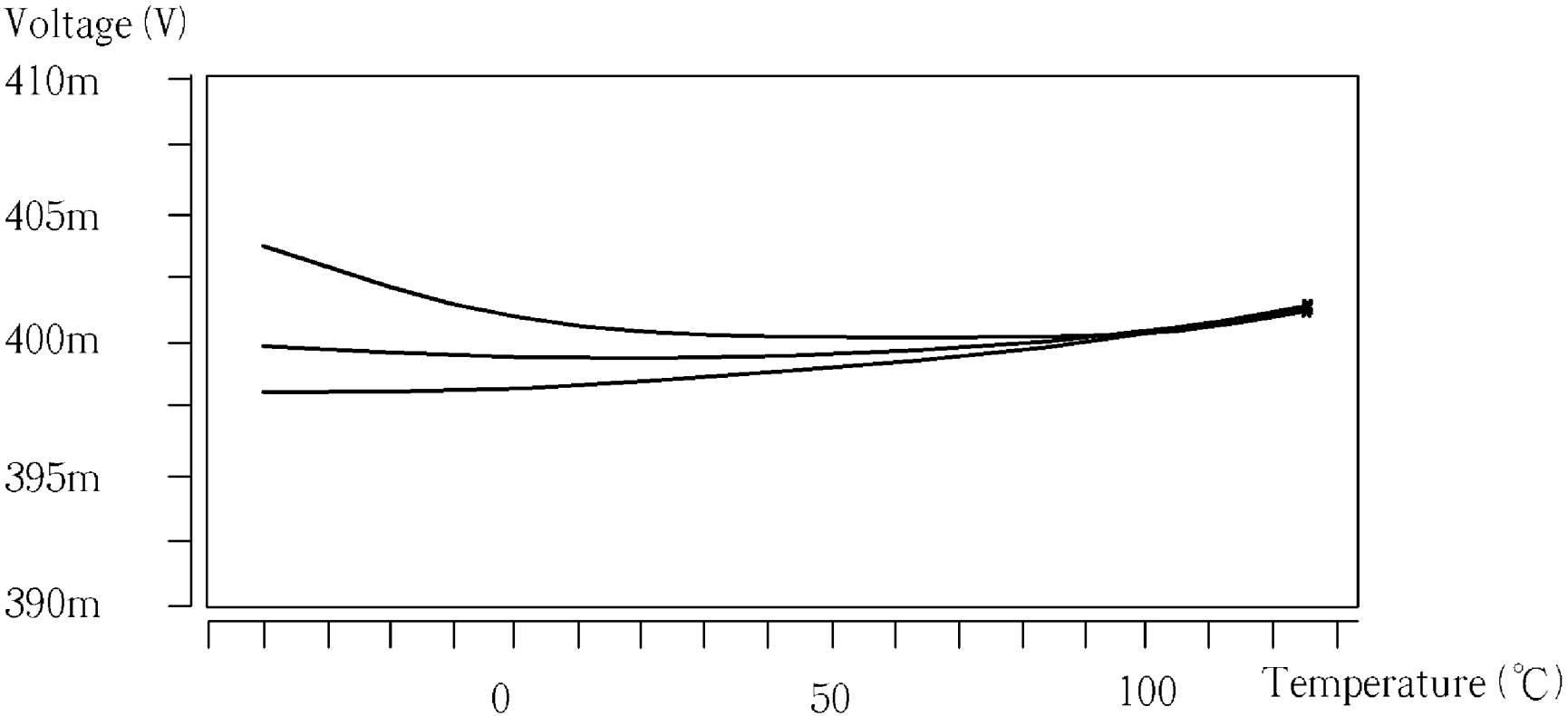
FIG. 8 illustrates the bandgap voltage generated by the bandgap reference circuit shown in FIG. 2 under the condition of PSNS.
Figure 9:
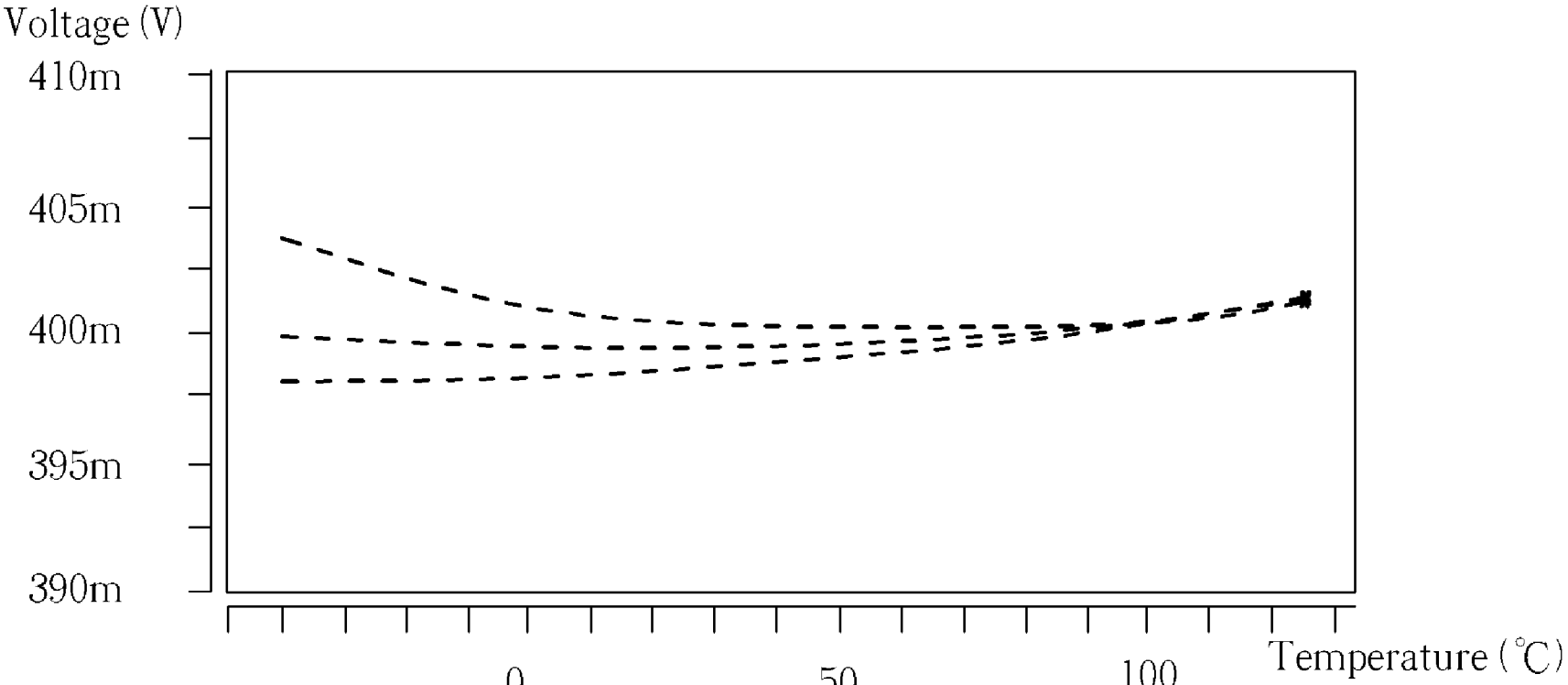
FIG. 9 illustrates the bandgap voltage generated by the bandgap reference circuit shown in FIG. 3 under the condition of PSNS.

Please refer to FIG. 8 and FIG. 9. FIG. 8 is a diagram of the bandgap voltage VREF' generated by the bandgap reference circuit 200 shown in FIG. 2 under the condition of PSNS, and FIG. 9 is a diagram of the bandgap voltage VREF" generated by the bandgap reference circuit 300 shown in FIG. 3 under the condition of PSNS, where the similarity between the two sets of curves means that the bandgap reference circuit 300 have similar performance as the bandgap reference circuit 200.

According to a variation of the first embodiment, a special case of the first embodiment, a resistor size such as the total resistor area of (R1"+2*RA+R2"+R3") of the resistors R1", RA, R2", and R3" utilized in the bandgap reference circuit 300 is compared with a corresponding resistor size such as the total resistor area of (R1'+2*R2'+R3') of the resistors R1', R2', and R3' utilized in the bandgap reference circuit 200. According to this variation, the amplifier 310, the PMOS transistors M1", M2", and M3", and the diodes D3-0, D3-1, D3-2, . . . , D3-N shown in FIG. 3 can be respectively implemented by utilizing the amplifier 210, the PMOS transistors M1', M2', and M3', and the diodes D2-0, D2-1, D2-2, . . . , D2-N shown in FIG. 2. Additionally, the resistors R1" and R3" shown in FIG. 3 can be respectively implemented by utilizing the resistors R1' and R3' shown in FIG. 2 (i.e., R1"=R1' and R3"=R3'). If the bandgap reference circuit 300 can be utilized for generating the same magnitude of the bandgap voltage VREF" as the bandgap voltage VREF' (i.e., VREF"=VREF'), Equations (11) and (4) can be substituted into the equation VREF"=VREF', so a simplified equation can be obtained as follows:

$$RA+2*R2''=R2'.$$

As a result, the difference between the respective resistor sizes (e.g. total resistor areas) of (R1'+2*R2'+R3') and (R1"+2*RA+R2"+R3") mentioned above can be calculated as follows:

$$(R1'+2*R2'+R3')-(R1''+2*RA+R2''+R3'')=(R''+2*R2'+R3'')-(R1''+2*RA+R2''+R3'')=(2*R2')-(2*RA+R2'')=(2*(RA+2*R2''))-(2*RA+R2'')=3*R2''.$$

In other words, in contrast to the bandgap reference circuit 200, the bandgap reference circuit 300 can save as large as three times the area occupied by the resistor R2". Therefore, in contrast to the bandgap reference circuit 200 of the prior art, the present invention provides a practical implementation method capable of improving the yield in a mass production phase of chips comprising bandgap reference circuits.

FIG. 10 is a table for comparing the corresponding resistance values of the bandgap reference circuit 300 shown in FIG. 3 and those of the bandgap reference circuit 200 shown in FIG. 2, where the resistance value of the total resistor (R1"+2*RA+R2"+R3") of the resistors R1", RA, R2", and R3" utilized in the bandgap reference circuit 300 is about 31.35% of that of the total resistor (R1'+2*R2'+R3') of the resistors R1', R2', and R3' utilized in the bandgap reference circuit 200, i.e. the total area of the resistors R1", RA, R2" and R3" utilized in the bandgap reference circuit 300 is about 31.35% of that of the resistors R1', R2', and R3' utilized in the bandgap reference circuit 200.

According to a variation of the first embodiment, the plurality of reference units can also be respectively implemented by utilizing dynamic threshold MOS transistors, and more particularly, in this variation, by utilizing dynamic threshold N-type MOS (DTNMOS) transistors.

According to another variation of the first embodiment, the plurality of reference units can be respectively implemented by utilizing MOS transistors operated in a weak inversion region thereof.

Those skilled in the art will readily observe that numerous modifications and alterations of the device and method may be made while retaining the teachings of the invention.

What is claimed is:

1. A bandgap reference circuit for generating a bandgap voltage, comprising:

a current generator for generating an output current, the current generator comprising a plurality of reference units comprising a first reference unit and a plurality of second reference units arranged in parallel, the current generator being capable of determining the magnitude of the output current according to the plurality of reference units, wherein a first portion of the output current is a current having a negative temperature coefficient, and a second portion of the output current is a current having a positive temperature coefficient;

a first resistor, coupled between a first terminal of the first reference unit and a node, for transmitting a first current;

a second resistor, coupled to the node and a first terminal of each second reference unit, for transmitting a second current;

a third resistor, coupled between the node and an output terminal of the bandgap reference circuit, for transmitting a third current, wherein the magnitude of the third current is equal to the sum of the magnitude of the first current and the magnitude of the second current; and a current-to-voltage converter, coupled to the third resistor, for generating the bandgap voltage according to the output current and the third current.

2. The bandgap reference circuit of claim 1, wherein the plurality of reference units comprises at least one diode or at least one transistor.

3. The bandgap reference circuit of claim 1, wherein each reference unit of the plurality of reference units comprises a second terminal coupled to a reference level.

4. The bandgap reference circuit of claim 1, wherein the current generator further comprises:

a fourth resistor comprising a first terminal and a second terminal, the second terminal being coupled to the first terminal of each second reference unit;

an amplifier comprising a positive input terminal coupled to the first terminal of the fourth resistor and a negative input terminal coupled to the first terminal of the first reference unit; and a plurality of p-type metal oxide semiconductor transistors (PMOS transistors), wherein a gate of each PMOS transistor is coupled to an output terminal of the amplifier, a source of each PMOS transistor is coupled to an operating voltage, and the plurality of PMOS transistors comprises:

a first PMOS transistor whose drain is coupled to the first terminal of the first reference unit;

a second PMOS transistor whose drain is coupled to the first terminal of the fourth resistor; and a third PMOS transistor whose drain outputs the output current to the current-to-voltage converter.

5. The bandgap reference circuit of claim 1, wherein a resistance value of the first resistor is substantially equal to that of the second resistor.

6. The bandgap reference circuit of claim 1, wherein each of the first and the second currents is a current having a positive temperature coefficient.

7. The bandgap reference circuit of claim 1, wherein the first and the second portions of the output current are currents of the same direction.

8. The bandgap reference circuit of claim 1, wherein the magnitude of the first portion of the output current is substantially equal to that of a current inputted into the first terminal of the first reference unit, and the magnitude of the second portion of the output current is substantially equal to that of the first current or that of the second current.

9. The bandgap reference circuit of claim 1, wherein the current-to-voltage converter converts a total current of the output current and the third current into the bandgap voltage.

10. The bandgap reference circuit of claim 1, wherein the current-to-voltage converter comprises a first terminal coupled to the third resistor and a second terminal coupled to a reference level.

11. The bandgap reference circuit of claim 1, wherein the current-to-voltage converter is a resistor.

12. The bandgap reference circuit of claim 2, wherein the plurality of reference units comprises the at least one transistor, and the transistor is a bipolar junction transistor (BJT).

13. The bandgap reference circuit of claim 2, wherein the plurality of reference units comprises the at least one transistor, and the transistor is a dynamic threshold metal oxide semiconductor (MOS) transistor.

14. The bandgap reference circuit of claim 2, wherein the plurality of reference units comprises the at least one transistor, and the transistor is a metal oxide semiconductor (MOS) transistor operated in a weak inversion region.

15. The bandgap reference circuit of claim 3, wherein the reference level is a ground level.

16. The bandgap reference circuit of claim 10, wherein the reference level is a ground level.

17. A method for generating a bandgap voltage, comprising:

providing a current generator comprising a plurality of reference units for determining the magnitude of an output current, wherein the plurality of reference units comprises a first reference unit and a plurality of second reference units arranged in parallel;

providing a first resistor, a second resistor, and a third resistor;

providing a current-to-voltage converter;

coupling the first resistor between a first terminal of the first reference unit and a node to transmit a first current;

coupling the second resistor to the node and a first terminal of each second reference unit to transmit a second current;

coupling the third resistor between the node and an output terminal of the bandgap reference circuit to transmit a third current, wherein the magnitude of the third current is equal to the sum of the magnitude of the first current and the magnitude of the second current;

utilizing the current generator to generate the output current, wherein a first portion of the output current is a current having a negative temperature coefficient and a second portion of the output current is a current having a positive temperature coefficient; and utilizing the current-to-voltage converter to generate the bandgap voltage according to the output current and the third current.

18. The method of claim 17, wherein the step of utilizing the current-to-voltage converter to generate the bandgap voltage according to the output current and the third current further comprises:

utilizing the current-to-voltage converter to convert a total current of the output current and the third current into the bandgap voltage.

19. The method of claim 17, wherein the plurality of reference units comprises at least one diode or at least one transistor.

20. The method of claim 17, wherein a resistance value of the first resistor is substantially equal to that of the second resistor.

* * * * *